United States Patent [19]

Sponer

[11] Patent Number: 4,801,465

[45] Date of Patent: Jan. 31, 1989

[54] DISPENSER APPARATUS FOR A SOLID PARTICULATE MATERIAL AND A FLUID

[76] Inventor: Richard A. Sponer, 36679 Arlene Dr., Sterling Heights, Mich. 48077

[21] Appl. No.: 40,165

[22] Filed: Apr. 20, 1987

[51] Int. Cl.[4] ..... B65D 83/14

[52] U.S. Cl. ..... 426/116; 222/135; 222/136; 222/402.24

[58] Field of Search ..... 426/116; 222/135, 136, 222/402.24

[56] References Cited

U.S. PATENT DOCUMENTS

| | | | |
|---|---|---|---|
| 2,073,779 | 3/1937 | Bramsen | 222/135 |
| 2,772,820 | 12/1956 | O'Donnell | 222/402.24 |
| 2,831,618 | 4/1958 | Soffer et al. | 222/402.24 |
| 2,941,696 | 6/1960 | Homm | 222/402.24 |
| 2,973,883 | 3/1961 | Modderno | 222/136 |
| 3,121,517 | 2/1964 | Geary et al. | 222/402.24 |
| 3,137,414 | 6/1964 | Steinkamp | 222/402.24 |
| 3,144,385 | 8/1964 | McGrew | 167/39 |
| 3,186,605 | 6/1965 | Potoczky | 222/402.24 |
| 3,189,466 | 6/1965 | McGrory | 99/123 |
| 3,236,418 | 2/1966 | Dalle et al. | 222/135 |
| 3,236,457 | 2/1966 | Kennedy et al. | 222/402.24 |
| 3,272,387 | 9/1966 | Katz et al. | 222/136 |
| 3,332,626 | 7/1967 | Meshberg | 222/402.24 |
| 3,405,846 | 10/1968 | Klun | 222/402.24 |
| 3,465,918 | 9/1969 | Webster | 222/136 |
| 3,490,923 | 1/1970 | Eiseman | 99/189 |
| 3,495,744 | 2/1970 | Webster | 222/402.24 |
| 3,511,414 | 5/1970 | Kinnavy et al. | 222/136 |
| 3,540,623 | 11/1970 | Wittke | 222/136 |
| 3,593,886 | 7/1971 | Morane | 222/136 |
| 3,620,763 | 11/1971 | Hans | 99/92 |
| 3,622,354 | 11/1971 | Diamond | 99/189 |
| 3,637,114 | 1/1972 | Meshberg | 222/135 |
| 3,653,551 | 4/1972 | Kuch | 222/136 |
| 3,680,738 | 8/1972 | Vos et al. | 222/136 |
| 3,693,837 | 9/1972 | Yuhas | 222/136 |
| 3,767,086 | 10/1973 | Steiman | 222/136 |
| 3,776,775 | 12/1973 | Lararus | 222/135 |
| 3,796,352 | 3/1974 | Morane | 222/135 |
| 3,849,580 | 11/1974 | Sejpal et al. | 426/116 |
| 3,920,158 | 11/1975 | Meshberg | 222/135 |
| 4,053,647 | 10/1977 | Prussin | 426/92 |
| 4,196,826 | 4/1980 | Abrioux et al. | 222/136 |
| 4,343,825 | 8/1982 | Takada et al. | 426/570 |

FOREIGN PATENT DOCUMENTS

| | | | |
|---|---|---|---|
| 0111089 | 6/1984 | European Pat. Off. | 222/135 |
| 2644780 | 4/1978 | Fed. Rep. of Germany | 222/136 |

*Primary Examiner*—Steven Weinstein

*Attorney, Agent, or Firm*—Basile and Hanlon

[57] ABSTRACT

A dispenser apparatus for dispersing a solid particulate material and a fluid simultaneously under pressure. The dispenser apparatus includes a sealed container having an aperture at a top end. A first conduit extends through the aperture into the interior of the container for flow of particulate material from the interior of the container. A second conduit sealed at one end is housed within the container and contains a pressurized fluid. Both of the first and second conduits are connected in fluid flow communication to first and second valves mounted at the top end of the container. The first and second valves are closed and opened to fluid flow via a cap mounted on the top end of the container. The cap is biased to a normal position closing the valves to fluid flow. A nozzle formed in the cap is connected via third and fourth conduits extending through the cap to the first and second conduits via the first and second valves to disperse the particulate material and the fluid simultaneously through the nozzle. Alternately, the third and fourth conduits may be joined together prior to dispersal through the nozzle. Also, separate nozzles may be provided for the third and fourth conduits to provide mixing of the particulate material and the fluid after dispersal from the nozzles.

9 Claims, 1 Drawing Sheet

DISPENSER APPARATUS FOR A SOLID PARTICULATE MATERIAL AND A FLUID

BACKGROUND OF THE INVENTION

1. Field of the Invention

This invention relates in general to dispensers for dispersing contents from the container and, specifically, to dispensers for dispensing two separate components housed within the container and, more specifically, to dispensers for dispersing two separate components in which one component is a particulate material and the other component is a fluid.

2. Description of the Prior Art

Pressurized containers for dispersing a fluid through a nozzle over a given area are well known. Such containers contain a fluid under suitable pressure, such as an aerosol or other inert fluid which disperses the contents of the container, such as paint, food pan coatings, etc.

Such containers include a nozzle which, when depressed, opens a valve within the container for dispersing the contents therefrom. Such pressurized containers have been devised for dispersing one or two separate fluids. In the multiple fluid container, the separate fluids housed within the container are mixed in the nozzle and are dispersed simultaneously and in conjunction from the container.

However, previously devised dispensers have been used only with fluids. It would be desirable to provide a dispenser which disperses a particulate material along with a fluid which is used to adhere the particulate material on a surface. This would provide an expedient means for coating a food product with a breading or other particulate coating in a simple and efficient manner.

SUMMARY OF THE INVENTION

The present invention is a dispensing apparatus for simultaneously dispensing a particulate material and a fluid material from a pressurized container. The dispensing apparatus comprises a container having a top end with an aperture. A particulate material is disposed within the container under pressure. A first conduit extends between the top and bottom ends of the container for flow of the particulate material therethrough. A second conduit having a loop or spiral configuration is housed within the container and contains a pressurized fluid suitable for wetting the particulate material so as to adhere it to the surface or article.

First and second valve means are mounted on the container in fluid flow communication with the first and second conduits, respectfully, to allow simultaneous flow of the particulate material and the fluid through third and fourth conduits mounted within a moving means attached to the top of the container to a nozzle. The moving means is mounted on the top end of the container and opens and closes the first and second valves allowing selective flow therethrough.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
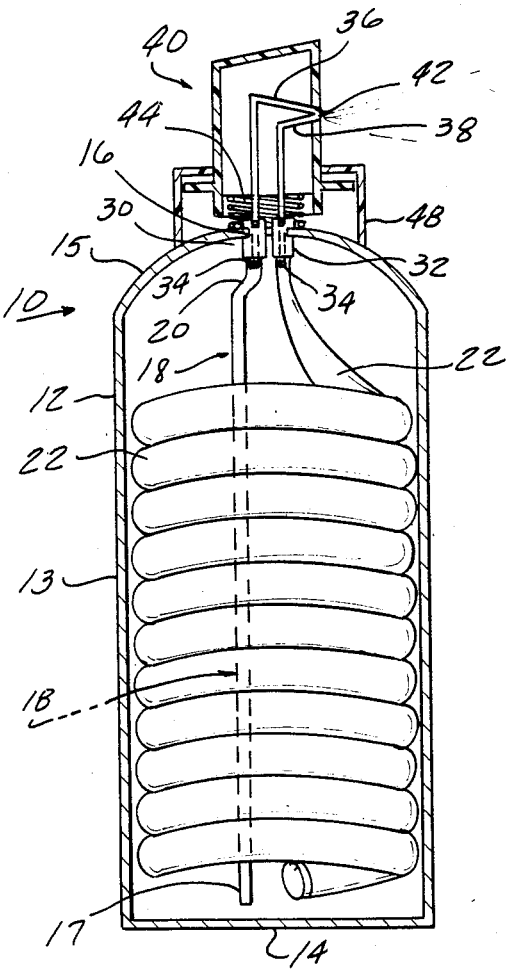
FIG. 1 is a cross sectional view of the dispenser apparatus of the present invention.

Throughout the following description and drawing, an identical reference number is used to refer to the same component shown in each figure of the drawing.

The present invention is a dispenser 10 which disperses a solid particulate material simultaneously with a fluid material to adhere the solid particulate material onto a surface, such as a food product.

The dispenser 10 is in the form of a container 12 having a sealed side wall 13, a bottom end 14, and a top end 15. The top end 15 has an aperture 16 formed therein. The container 12 can be formed of any suitable material, such as a metallic material including aluminum, stainless steel, etc., as well as a plastic which has sufficient strength to withstand the pressure exerted by the components housed within the container 12. Further, if a metal is employed to form the container 12, a thin plastic film may be disposed on the inner surface to prevent condensation build-up on the side walls 13 which could lead to congealing of the material housed within the container 12.

The solid particulate material, not shown in FIG. 1, is disposed under a suitable pressure within the interior of the container 12. In a preferred embodiment, the solid particulate material is in the form of particulate breading of bread crumbs, although any form of pulverized, powdered, granular or other fine particulate material may be used for coating a meat food product as described hereafter.

A first conduit 18 is mounted within the interior of the container 12 and extends from an end 17 located in proximity with the bottom of the container 14 as shown in FIG. 1. This provides fluid flow of the particulate material within the container 12 through the conduit 18 from its bottom end 17 to its upper end 20.

A second conduit 22 is also housed within the container 12 in the form of a spiral or coil as illustrated in general by reference number 22. In a preferred embodiment, the second conduit 22 has a circular cross section; although other cross sections, such as square, triangular, etc., may also be employed. Also, the length and diameter of the second conduit 22 and the spacing between the coils or loops of the conduit 22 may be varied depending upon the volume of fluid which is be dispersed from the container 12. While the coils of the conduit 22 are shown as stacked or co-axial within the container 12, they may be spaced apart, again depending upon the volume of fluid to be dispensed from the container 12.

The fluid within the conduit 22 may be of any type of edible fluid which can adhere the solid particulate material to an object or surface. This may be, preferably, water, or any other material, such as vegetable oil, cooking oil or combinations thereof which can adhere the solid particulate material to a food product.

The fluid is disposed within the conduit 22 under a suitable pressure. Likewise, the solid particulate material within the container 12 is also disposed within the container 12 under a pressure suitable for dispensing the particulate material over a given area.

First and second valve means 30 and 32 are mounted in an aperture 16 in the top end 15 of the container 12. The valve means 30 and 32 are respectfully connected to the upper ends of the first and second conduits 18 and 22.

The valves 30 and 32 are sealingly mounted in the aperture 16 in the top end 15 of the container 12. The valves 30 and 32 each include a housing having a through bore 33 extending therethrough. The top ends of the first and second conduits 18 and 22 are connected in fluid flow communication with the bores 33.

An aperture 34 is formed laterally in the lower end of each of third and fourth conduits 36 and 38 above the sealed or closed lower end of each conduit 36 and 38. The apertures 34 are positioned so as to be disposed within the interior of the valves 30 and 32 when the third and fourth conduits 36 and 38 are in the raised position as described hereafter and shown in FIG. 2 to close off fluid or particulate flow therethrough from the container 12 and the second conduit 22.

Downward movement of the third and fourth conduits 36 and 38 will lower the apertures 34 through the valves 30 and 32 thereby placing the apertures 34 in fluid flow communication with the first and second conduits 18 and 22 allowing the simultaneous pressurized flow from the first and second conduits 18 and 22 through the valves 30 and 32 and the third and fourth conduits 36 and 38 outward through a nozzle 42.

Moving means are provided for opening and closing the first and second valves 30 and 32 simultaneously to the flow of fluid and particulate material. The moving means 40 is in the form of a depressible cap mounted on the top end 15 of the container 12. The cap 40 has the third and fourth conduits 36 and 38 extending therethrough which are disposed in fluid flow communication with a nozzle means 42 in the form of an aperture extending through a side wall of the cap 40.

Figure 2:
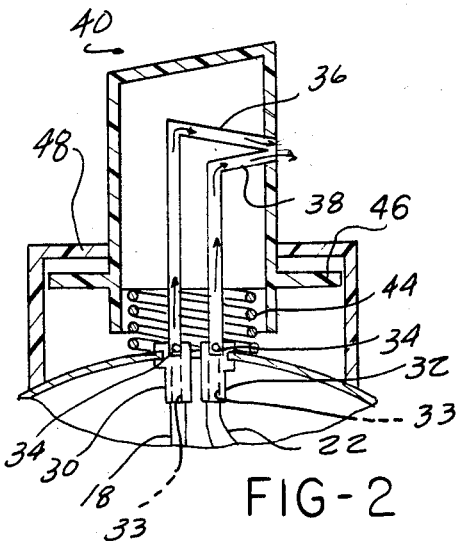
FIG. 2 is a partial, enlarged view of one embodiment of the nozzle portion of the dispenser apparatus of the present invention.

A biasing means 44 is mounted between the bottom end of the cap or moving means 40 and the top end of the container 12. The biasing means 44 preferably is in the form of a coil spring as depicted in FIGS. 1 and 2.

Stop means in the form of a radially extending flange 46 is mounted or molded on the bottom end of the cap 40 and engages the upper end of a ring member 48 mounted on the top end 14 of the container 12 to limit upward movement of the cap 40 under force from the biasing means 40.

Release of the cap member 40 under the bias of the spring 44 allows upward movement of the cap or moving means 40 until the flange 46 engages the inner portion of the upper end of the ring member 48 thereby stopping upward movement of the cap 40.

Figure 3:
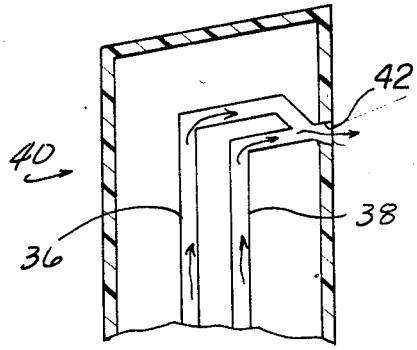
FIG. 3 is an enlarged view of an alternate embodiment of the nozzle.

An alternate embodiment of the nozzle 42 is illustrated in FIG. 3. In this embodiment, the end of one of the conduits, such as conduit 38, is interconnected with the upper end of the other conduit 36 ahead of the nozzle aperture 42. This provides a mixing of the solid particulate material with the pressurized fluid prior to their simultaneous dispersal from the nozzle 42.

Figure 4:
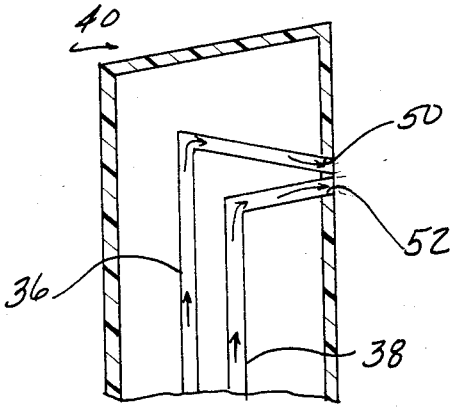
FIG. 4 is yet another embodiment of the nozzle.

Alternately, the conduits 36 and 38 may be provided with a separate apertures or nozzles 50 and 52, respectively, as shown in FIG. 4. In this embodiment, the separate apertures or nozzles 50 and 52 for each of the third and fourth conduits 36 and 38 are spaced apart where they exit the housing 40; but are angled towards each other to provide mixing of the components flowing therethrough.

There has been disclosed a unique apparatus which provides dispensing of a solid particulate material and a fluid material, each under pressure, through a nozzle. The apparatus is uniquely devised to provide mixing of the two disparate components for adhesion on a food product.

What is claimed is:

1. A dispenser apparatus comprising:

a container having a top end and sealed sides and bottom ends with an aperture formed in the top end, the top end, sides and bottom end forming a first chamber in the interior of the container;

a particulate material stored within the first chamber in the container under pressure;

a first conduit extending from the proximity of the aperture in the top end of the container into the first chamber in the interior of the container for the flow of particulate material therethrough;

a second conduit housed within the first chamber in the container and extending in a spiral configuration from one end disposed in the proximity of the aperture in the top end of the container to a sealed other end, the interior of the second conduit forming a second chamber;

a fluid stored under internal pressure within the second chamber in the second conduit;

first and second valve means mounted in the aperture in the top end of the container and disposed in fluid flow communication with the first and second conduits, respectively;

moving means for simultaneously opening and closing the first and second valve means to the flow of particulate material and fluid from the first and second conduits, respectively;

nozzle means formed in the moving means for simultaneously dispersing and mixing the particulate material and the fluid therefrom; and third and fourth conduits disposed within the moving means and slidably disposed at one end in the first and second valve means, respectively, and connected to the nozzle means at the other end.

2. The dispenser apparatus of claim 1 wherein the moving means comprises:

a depressible cap member mounted on the top end of the container.

3. The dispenser apparatus of claim 2 further including:

means for biasing the cap member away from the top end of the container to a position closing the first and second valve means to the flow of particulate material and fluid therethrough.

4. The dispenser apparatus of claim 3 wherein the biasing means comprises a coil spring disposed between the top end of the container and the cap member.

5. The dispenser apparatus of claim 1 wherein the moving means further includes:

stop means for limiting the upward movement of the moving means;

the stop means including:

a ring member attached to the top of the container; and radially extending flanges mounted on the moving means and engageable with the ring member to limit upper movement of the moving means.

6. The dispenser apparatus of claim 1 wherein the nozzle means includes:

an aperture formed in the moving means; and the third and fourth conduits being disposed in combined fluid flow communication with the aperture in the moving means.

7. The dispenser apparatus of claim 1 wherein the nozzle means includes:

an aperture formed in the moving means; and the third conduit being disposed in fluid flow communication with the fourth conduit prior to communicating with the aperture in the moving means.

8. The dispenser apparatus of claim 1 wherein the nozzle means includes first and second apertures;

the third and fourth conduits, respectively, dispensing the particulate material and the fluid through the first and second apertures respectively.

9. The dispenser apparatus of claim 8 wherein the outlet ends of the third and fourth conduits are directed towards each other to mix the particulate material and the fluid together prior to exit from the nozzle means.

* * * * *